US010232242B2

(12) United States Patent
Guerrero

(10) Patent No.: US 10,232,242 B2
(45) Date of Patent: Mar. 19, 2019

(54) DEVICES TO IMPROVE SWING TECHNIQUE, AND METHODS OF USE THEREOF

(71) Applicant: Kelvin Guerrero, Tracyton, WA (US)

(72) Inventor: Kelvin Guerrero, Tracyton, WA (US)

( * ) Notice: Subject to any disclaimer, the term of this patent is extended or adjusted under 35 U.S.C. 154(b) by 0 days.

(21) Appl. No.: 14/857,395

(22) Filed: Sep. 17, 2015

(65) Prior Publication Data

US 2016/0082337 A1 Mar. 24, 2016

Related U.S. Application Data

(60) Provisional application No. 62/052,972, filed on Sep. 19, 2014.

(51) Int. Cl.

| | |
|---|---|
| ***A63B 69/00*** | (2006.01) |
| ***A63B 71/06*** | (2006.01) |
| *A63B 102/32* | (2015.01) |
| *A63B 102/18* | (2015.01) |

(52) U.S. Cl.

CPC ..... *A63B 69/0002* (2013.01); *A63B 71/0619* (2013.01); *A63B 71/0622* (2013.01); *A63B 2069/0008* (2013.01); *A63B 2071/0625* (2013.01); *A63B 2071/0655* (2013.01); *A63B 2071/0694* (2013.01); *A63B 2102/18* (2015.10); *A63B 2102/32* (2015.10); *A63B 2208/0204* (2013.01); *A63B 2220/836* (2013.01)

(58) Field of Classification Search

CPC ..... A63B 69/0002; A63B 71/0619; A63B 71/0622; A63B 2102/18; A63B 2102/32; A63B 2069/0008; A63B 2071/0625; A63B 2071/0694; A63B 2208/0204; A63B 2220/836

USPC ..... 473/422, 450, 458, 464, 208, 211, 209; 128/861, 857–859, DIG. 23; 2/9, 455; 602/17; 600/595

See application file for complete search history.

(56) References Cited

U.S. PATENT DOCUMENTS

| | | | | | |
|---|---|---|---|---|---|
| 2,774,601 | A * | 12/1956 | White | A63B 69/0059 | 473/208 |
| 3,713,657 | A * | 1/1973 | Presta | A63B 69/0059 | 473/208 |
| 4,300,765 | A * | 11/1981 | Stringham | A63B 69/0002 | 473/211 |
| 4,446,480 | A * | 5/1984 | Breglia | G02B 27/017 | 434/44 |
| 4,527,982 | A * | 7/1985 | Salzman | A63B 69/00 | 473/464 |
| 4,746,118 | A * | 5/1988 | Deveney | A63B 69/0002 | 473/458 |
| 4,826,165 | A * | 5/1989 | Socci | A63B 69/0002 | 473/458 |
| 5,118,104 | A * | 6/1992 | DeLanzo | A63B 69/0002 | 473/458 |

(Continued)

*Primary Examiner* — Mitra Aryanpour
(74) *Attorney, Agent, or Firm* — Lee & Hayes, P.C.

(57) ABSTRACT

Described herein are devices that can be used to improve swing technique and methods of using the same. The devices provide alerts indicating a trainee's use of proper and/or improper technique during a swing either in real-time or after a delay, thereby improving the trainee's swing technique, including body positioning. Exemplary uses include improving swing technique in baseball, golf, and similar sports or activities.

18 Claims, 4 Drawing Sheets

(56) References Cited

U.S. PATENT DOCUMENTS

| | | | | | |
|---|---|---|---|---|---|
| 5,174,564 | A * | 12/1992 | Young, III | A63B 69/0059 | 473/458 |
| 5,251,902 | A * | 10/1993 | Federowicz | A63B 69/3608 | 473/209 |
| 5,447,305 | A * | 9/1995 | Socci | A63B 69/3608 | 473/458 |
| 5,469,861 | A * | 11/1995 | Piscopo | A61B 5/103 | 600/594 |
| 5,524,894 | A * | 6/1996 | Shannon | A63B 69/3608 | 473/209 |
| 5,713,804 | A * | 2/1998 | Socci | A63B 69/0002 | 473/422 |
| 5,746,663 | A * | 5/1998 | Calace | A63B 69/0002 | 473/458 |
| 6,730,047 | B2 * | 5/2004 | Socci | A63B 69/3608 | 600/595 |
| 7,383,728 | B2 * | 6/2008 | Noble | A63B 69/3608 | 600/595 |
| 8,043,173 | B2 * | 10/2011 | Menalagha | A63B 71/0622 | 473/450 |
| 2009/0260634 | A1 * | 10/2009 | Navarrette, Jr. | A42B 3/205 | 128/861 |
| 2016/0082337 | A1 * | 3/2016 | Guerrero | A63B 69/0002 | 473/458 |

* cited by examiner

DEVICES TO IMPROVE SWING TECHNIQUE, AND METHODS OF USE THEREOF

CROSS REFERENCE TO RELATED APPLICATIONS

The present application claims priority to U.S. Provisional Patent Application No. 62/052,972, filed on Sep. 19, 2014, which is incorporated by reference herein in its entirety.

FIELD OF THE DISCLOSURE

The present disclosure relates to devices and methods for their use for improving a user's swing technique, including body positioning. Exemplary uses include improving swing technique in baseball, golf, and similar sports or activities.

BACKGROUND OF THE DISCLOSURE

In sports or other activities in which swinging a club, racket, bat, stick, or the like is required, proper swing technique, including body positioning, can be difficult to accomplish consistently. Many sports require the player to maintain their head in a specific position while swinging to facilitate making contact with the intended object, such as a ball or puck.

Many of the existing systems intended to train a player in proper swing technique require a complicated set-up process, wherein several parts are positioned on specific areas of a user's body. This requires the user to measure, or approximate and then adjust the placement of the parts in order to properly position them. Additionally, some systems require specialized garments. Further, a number of previously described systems require a user's vision to be obstructed, which can be dangerous in activities where a ball or puck is traveling toward the user.

SUMMARY OF THE DISCLOSURE

The present disclosure relates to devices and methods for their use in improving a trainee's swing technique, including body positioning. In some embodiments, the devices include three components: a positioning component, an alert component, and a sensory component. Unlike many of the previously-available systems, which adopt an approach which requires a number of extra steps or extensive experimentation to achieve the optimum result, the devices disclosed herein are easy to put on, position properly, and take off, allowing for easy transfer from one trainee to another. The devices disclosed herein neither require specialized garments, nor obstruct the trainee's vision, and are durable and light-weight.

BRIEF DESCRIPTION OF THE FIGURES

The Detailed Description is set forth with reference to the accompanying figures. In the figures, the left-most digit(s) of a reference number identifies the figure in which the reference number appears. The use of the same reference numbers in different figures indicates similar or identical items.

FIG. 2A shows a left-handed user wearing an exemplary device at the beginning of a swing, FIG. 2B shows the user wearing the exemplary device mid-swing, and FIG. 2C shows the user wearing the exemplary device at the end of the swing.

FIG. 3A shows a right-handed user wearing an exemplary device at the beginning of a swing, FIG. 3B shows the user wearing the exemplary device mid-swing, and FIG. 3C shows the user wearing the exemplary device at the end of the swing.

DETAILED DESCRIPTION

Disclosed herein are devices to improve swing technique, including body positioning, and methods of using the same. The devices alert a trainee if he or she is using proper and/or improper body positioning, specifically head and/or neck positioning, in real-time during a swing.

"Trainee" refers to the individual who wears a device during a swing. A "user" can include the trainee, as well as a coach, a trainer, a therapist, a teammate, or any other individual.

The devices and methods of this disclosure can also beneficially be used in various embodiments simply for exercise, such as aerobic exercise, individual or group play, team games, or other recreation. In various embodiments, the devices and methods disclosed herein can be used to improve swing technique in, for example, hockey, cricket, golf, baseball, croquet, polo, and the like.

"Improve" or "improving", etc. refers to any effect on a trainee's swing technique that does not worsen it. As used herein, the terms "improve", "improving", etc. can include: using a better body position; achieving a goal with regard to the swing technique, such as increasing the percentage of swings that result in a hit; maintaining the percentage of swings that result in a hit; increasing or maintaining the distance an object travels after being hit; refining body positioning such that objects are hit toward their target more accurately; and the like.

Figure 1B:
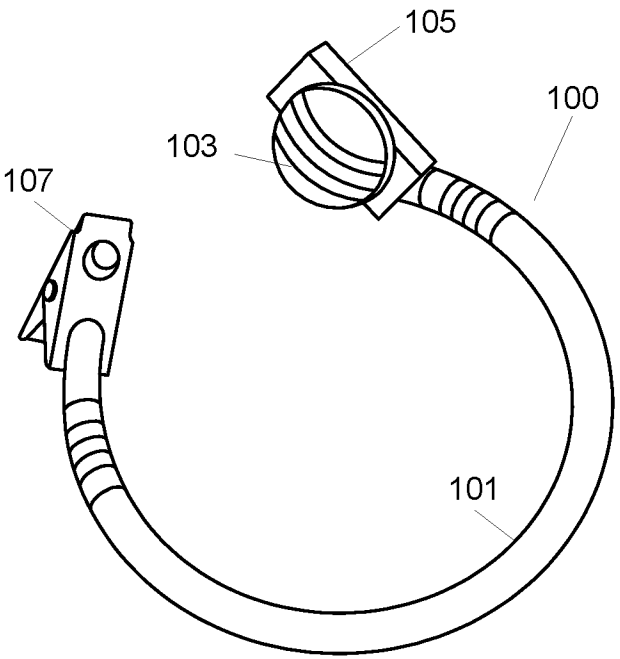
FIG. 1B shows a second perspective view of the same exemplary device.
Figure 1A:
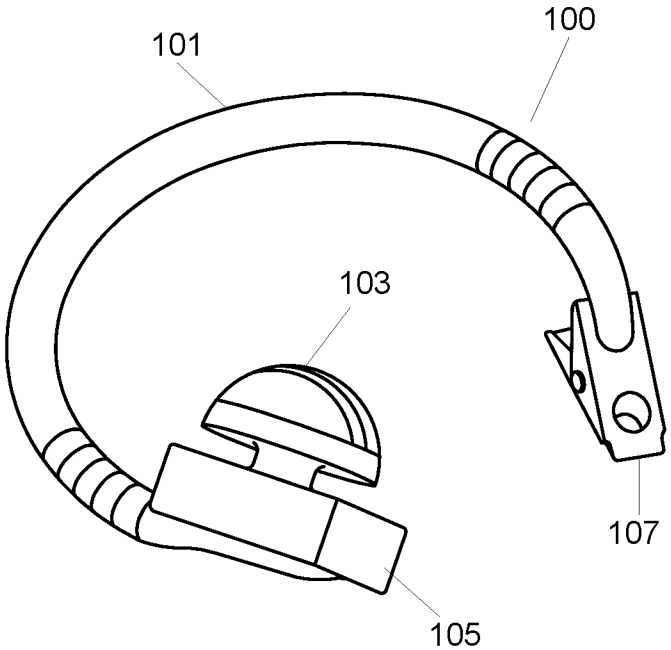
FIG. 1A shows one perspective view of an exemplary device.
Figure 2C:
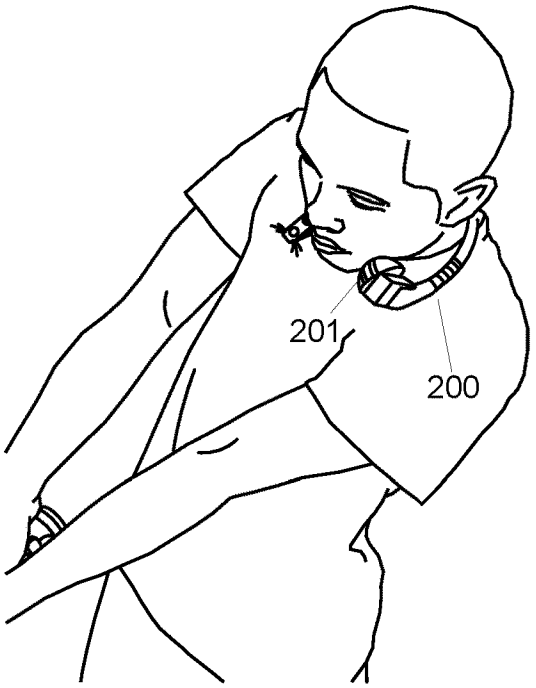
FIGS. 2A-2C show a left-handed user wearing an exemplary device while swinging a baseball bat.
Figure 2B:
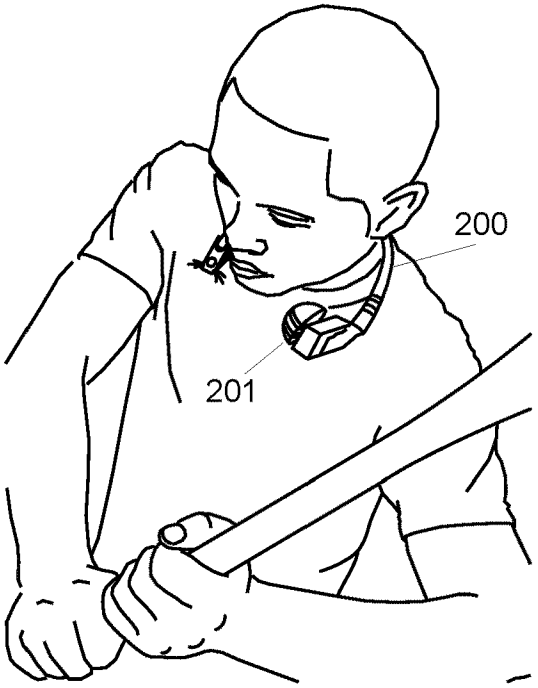
Figure 2A:
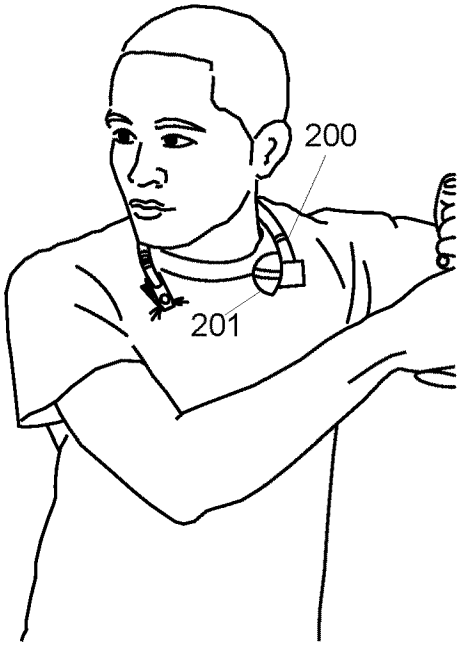
Figure 3C:
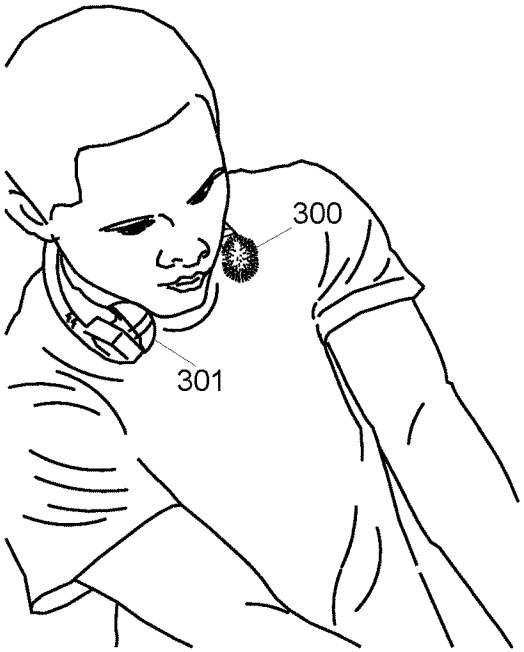
FIGS. 3A-3C show a right-handed user wearing an exemplary device while swinging a baseball bat.
Figure 3B:
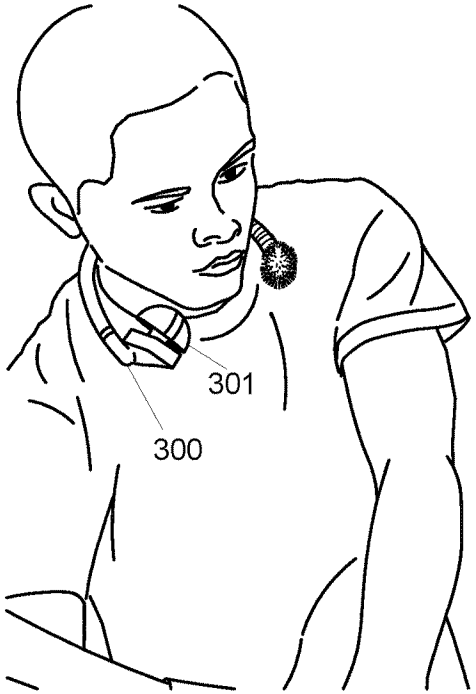
Figure 3A:
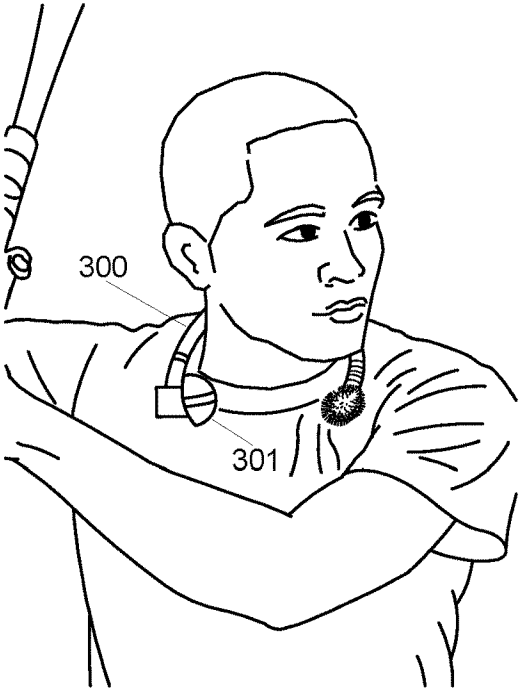

The devices disclosed herein are made up of three components, a positioning component 101, a sensory component, and an alert component. One exemplary device 100 is shown in FIGS. 1A and 1B. As shown in this example, the positioning component 101 can be coupled to the alert component 105, and the alert component 105 is coupled to the positioning component 101 and the sensory component 103. In this embodiment, the positioning component 101, further includes a securing device 107. In various embodiments, the alert component 105 can be physically coupled to the positioning component 101 and/or sensory component 103, or the alert component 105 can be independent. For example, the alert component may be physically decoupled, but communicatively coupled to the sensory component (e.g., via wireless communication protocol). Various configurations of the components, and particularly placement of the alert component 105, can be adopted without departing from the spirit and scope of the current disclosure.

The positioning component 101 allows the device 100 to maintain the proper position while being worn by the trainee, as can be seen in FIGS. 2A-3C. The positioning component 101 maintains the device 100 in a position such that the trainee's chin can make contact with the sensory component 103 during a proper swing, and/or break contact during an improper swing. For example, a trainee using a device 100 to improve his or her swing technique while playing baseball can select a mode such that the device 100 alerts him or her if, at the end of the swing, his or her chin makes contact with the sensory component 103. This alert would indicate that his or her head was in the proper position at the end of the swing. If contact of the trainee's chin with the sensory component 103 is not made, the alert would not sound, and the trainee and/or user would know that proper swing technique was not achieved. Although reference to the trainee's chin is made throughout the present disclosure, if the directionality of the sensory component 103 of the devices 100 is changed, the sensory component 103 could make contact with a trainee's shoulder without losing functionality or departing from the spirit or scope of the disclosure.

In another example, a trainee using a device 100 to improve his or her swing technique while playing golf could select a mode such that the device 100 alerts him or her if his or her chin ceased to make contact with the sensory component 103 during a swing. This alert would indicate that his or her head had been in the proper position at the beginning of the swing, but that his or her head ceased to be in the proper position at the moment his or her chin ceased to make contact with the sensory component 103. If the alert does not sound during a swing in this embodiment, proper head positioning was maintained throughout the swing.

In another example, a trainee using a device 100 to improve his or her swing technique could select a mode such that the device 100 alerts him or her if his or her chin failed to make contact with the sensory component 103 during a swing. If the alert does not sound during a swing in this embodiment, proper head positioning was maintained throughout the swing.

In various embodiments, the positioning components 101 of devices are U-shaped with the approximate vertex of the positioning component 101 resting on the dorsal surface of the trainee's neck when in use, and extending down the anterior surface of the trainee's shoulders, and optionally chest. In various embodiments, the portions of the positioning component 101 that extend down the anterior surface of the trainee's shoulders, and optionally chest, can be substantially the same length on each side. In various embodiments, the portions of the positioning component that extend down the anterior surface of the trainee's shoulders can be different lengths on each side.

In various embodiments, the devices disclosed herein can include a positioning component 101 that is U-shaped. In some embodiments, the positioning component 101 is substantially U-shaped. In various embodiments, the positioning component 101 could be shaped like an arch, a parabola, V-shaped, or the like. In various embodiments, the positioning component 101 is symmetrical. In some embodiments, the positioning component is asymmetrical.

The positioning component can be made of any material that is durable and flexible enough to allow for donning, positioning, and doffing as described herein, as is understood by one of ordinary skill in the art. In various embodiments, the positioning component can be at least partially made of one or more plastics, such as polyurethane, nylon, polyethylene, poly-vinyl chloride, polypropylene, vinyl, fiber-reinforced plastic (e.g. carbon fiber), and the like. In other embodiments, the positioning component can be made at least partially of one or more metals. In specific embodiments, the metal is in the form of wire. In various embodiments, the positioning component can be at least partially made of foam (e.g. polyether, polyester, ethafoam, volara, closed-cell sponge rubber, and the like) and/or fabric (e.g., nylon, cotton, neoprene, polyester, and the like). In specific embodiments, the positioning component can include a coating such as plastic dip, non-stick backing, fabric paint, silicone sealant, and the like. In some embodiments, the coating is non-slip, anti-slip, or otherwise increase the friction between the trainee and the positioning component. In specific embodiments, the positioning component can be made of a flexible bistable spring contained within a fabric, plastic, or foam cover, such that the function is similar to a 'slap bracelet'.

In particular embodiments, portions of the positioning component can be weighted to facilitate proper positioning of the device during use. Exemplary placements for optimal weighting could include one or more ends and/or the midpoint of the positioning component. The positioning component could also be shaped and/or contoured to facilitate maintenance of position and/or could be made of a compressible and/or formable material, such as a foam. If a device was intended to be used by one particular trainee over time, the material could retain shape memory, such as a specialized foam. In other embodiments, if a device was intended to be used by a team, the material could lack shape memory and return to a baseline shape in between use by trainees.

In various embodiments, the positioning component can be between 10 and 45 inches long. In various embodiments, the positioning component can be at least 10 inches, at least 11 inches, at least 12 inches, at least 13 inches, at least 14 inches, at least 15 inches, at least 16 inches, at least 17 inches, at least 18 inches, at least 19 inches, at least 20 inches, at least 21 inches, at least 22 inches, at least 23 inches, at least 24 inches, at least 25 inches, at least 26 inches, at least 27 inches, at least 28 inches, at least 29 inches, at least or 30 inches, at least 31 inches, at least 32 inches, at least 33 inches, at least 34 inches, at least 35 inches, at least 36 inches, at least 37 inches, at least 38 inches, at least 39 inches, at least 40 inches, at least 41 inches, at least 42 inches, at least 43 inches, at least 44 inches, or at least 45 inches long. In various embodiments, the positioning component can be no greater than 10 inches, no greater than 11 inches, no greater than 12 inches, no greater than 13 inches, no greater than 14 inches, no greater than 15 inches, no greater than 16 inches, no greater than 17 inches, no greater than 18 inches, no greater than 19 inches, no greater than 20 inches, no greater than 21 inches, no greater than 22 inches, no greater than 23 inches, no greater than 24 inches, no greater than 25 inches, no greater than 26 inches, no greater than 27 inches, no greater than 28 inches, no greater than 29 inches, no greater than or 30 inches, no greater than 31 inches, no greater than 32 inches, no greater than 33 inches, no greater than 34 inches, no greater than 35 inches, no greater than 36 inches, no greater than 37 inches, no greater than 38 inches, no greater than 39 inches, no greater than 40 inches, no greater than 41 inches, no greater than 42 inches, no greater than 43 inches, no greater than 44 inches, or no greater than 45 inches long.

In various embodiments, the length of the positioning component can be adjustable. In one embodiment, portions of the positioning component can telescope to adjust the length. Alternatively or additionally, "extenders" can be attached to the ends of or within the length of a positioning component. In various embodiments, the adjustable positioning component can be at least 10 inches, at least 11 inches, at least 12 inches, at least 13 inches, at least 14 inches, at least 15 inches, at least 16 inches, at least 17 inches, at least 18 inches, at least 19 inches, at least 20 inches, at least 21 inches, at least 22 inches, at least 23 inches, at least 24 inches, at least 25 inches, at least 26 inches, at least 27 inches, at least 28 inches, at least 29 inches, at least or 30 inches, at least 31 inches, at least 32 inches, at least 33 inches, at least 34 inches, at least 35 inches, at least 36 inches, at least 37 inches, at least 38 inches, at least 39 inches, at least 40 inches, at least 41 inches, at least 42 inches, at least 43 inches, at least 44 inches, or at least 45 inches long. In various embodiments, the adjustable positioning component can be no greater than 10 inches, no greater than 11 inches, no greater than 12 inches, no greater than 13 inches, no greater than 14 inches, no greater than 15 inches, no greater than 16 inches, no greater than 17 inches, no greater than 18 inches, no greater than 19 inches, no greater than 20 inches, no greater than 21 inches, no greater than 22 inches, no greater than 23 inches, no greater than 24 inches, no greater than 25 inches, no greater than 26 inches, no greater than 27 inches, no greater than 28 inches, no greater than 29 inches, no greater than or 30 inches, no greater than 31 inches, no greater than 32 inches, no greater than 33 inches, no greater than 34 inches, no greater than 35 inches, no greater than 36 inches, no greater than 37 inches, no greater than 38 inches, no greater than 39 inches, no greater than 40 inches, no greater than 41 inches, no greater than 42 inches, no greater than 43 inches, no greater than 44 inches, or no greater than 45 inches long.

Adjustable positioning components can also come in size ranges having length ranges for example, from 10-45 inches; from 10-20 inches; from 15-25 inches; from 20-45 inches; and any other possible range within the disclosed lengths. In these embodiments, size ranges can be provided for teams ranging from little league teams to major league baseball teams depending on the length range chosen.

In various embodiments, the device can be donned and properly positioned on the trainee in less than one minute, in less than 45 seconds, in less than 30 seconds, in less than 25 seconds, in less than 20 seconds, in less than 15 seconds, in less than 14 seconds, in less than 13 seconds, in less than 12 seconds, in less than 11 seconds, in less than 10 seconds, in less than 9 seconds, in less than 8 seconds, in less than 7 seconds, in less than 6 seconds, in less than 5 seconds, or in less than 2 seconds.

In various embodiments, the positioning component can include a securing device. In various embodiments, the securing device is coupled to the rest of the positioning component on the opposite end of the positioning component from the sensory component. This configuration is shown in FIG. 1A where the securing device 107 is coupled to the positioning component 101 at the opposite end of the positioning component 101 from the sensory component 103. In various embodiments, the securing device is coupled to the positioning component in substantially the same area as the sensory component or at any length along the length of the positioning component.

Exemplary securing devices include clips, such as alligator clips, crocodile clips, suspender clips, and badge clips; magnetic attachments; adhesives; and pins, such as safety pins, bar pins, or locking pins.

In various embodiments, the device can be donned, properly placed, and secured in less than one minute, in less than 45 seconds, in less than 30 seconds, in less than 25 seconds, in less than 20 seconds, in less than 15 seconds, in less than 14 seconds, in less than 13 seconds, in less than 12 seconds, in less than 11 seconds, in less than 10 seconds, in less than 9 seconds, in less than 8 seconds, in less than 7 seconds, in less than 6 seconds, in less than 5 seconds, or in less than 2 seconds.

The sensory component of the devices disclosed herein makes contact with the trainee's chin and/or shoulder when the trainee is utilizing proper body positioning. For example, in FIGS. 2A-2C, the sensory component 201 of the device 200 makes contact with the trainee's chin at the end of the swing because the trainee is using proper body positioning. Similarly, in FIG. 3A-3C, the sensory component 301 of the device 300 makes contact with the trainee's chin at the end of the swing because the trainee is using proper body positioning.

Figure 4:
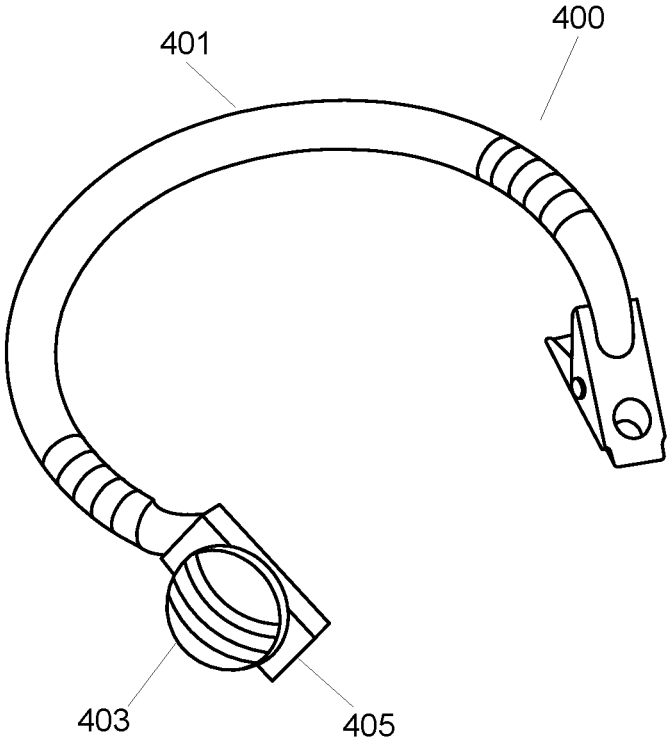
FIG. 4 shows a perspective view of an exemplary device.

Another exemplary device 400 is shown in FIG. 4. As shown in this example, the positioning component 401 can be coupled to the alert component 405, and the alert component 405 is coupled to the positioning component 401 and the sensory component 403. In this embodiment, the sensory component is configured to make contact with the trainee's shoulder at the end of the swing. In some embodiments, the alert component and/or the sensory component can be adjusting using any suitable mechanical mechanism, such as a click-and-lock mechanism, a flexible attachment, a ball bearing system, a ball in socket mechanism, and the like.

In various embodiments, the sensory component is configured to send a signal to the alert component when the trainee's chin makes contact toward the end of the swing, thereby alerting a user that the trainee utilized proper body positioning (here, the user and trainee can be the same or two different people). In other embodiments, the sensory component is configured to send a signal to the alert component when the trainee's shoulder makes contact with the sensory component toward the end of the swing.

In various embodiments, the sensory component is configured to send a signal to the alert component when the trainee's chin ceases to make contact with the sensory component, thereby alerting a user that the trainee is no longer utilizing proper body positioning (here again, the user and trainee can be the same or two different people and the disclosure should be interpreted accordingly throughout as appropriate for the particularly described context). In various embodiments, the sensory component is configured to send a signal to the alert component when the trainee's shoulder ceases to make contact with the sensory component.

In various embodiments, the sensory component is made up of a detector contained in, or coupled with, a housing. Any type of detector known in the art may be used in the sensory component, such as a mechanical sensor (e.g., whisker-like fiber), an electronic sensor (e.g., ultrasonic, microwave, infrared, laser, videographic, tomographic, capacitive, resistive, and the like), or combinations thereof and as is understood by one of ordinary skill in the art.

The sensory component may be any shape that allows for the trainee's chin and/or shoulder to make contact while the trainee's head is in the proper position. In various embodiments, the sensory component can be hemispherical in shape. In various embodiments, the sensory component can be shaped as a cuboid. In various embodiments, the sensory component can be shaped as a prism, cylinder, cone, sphere, or the like.

In various embodiments, the sensory component includes a button that is depressed by the trainee's chin when the trainee is using proper body positioning. In various embodiments, the sensory component includes a button that is depressed by a housing when trainee's chin makes contact with the housing when the trainee is using proper body positioning.

In various embodiments, the sensory component includes a touch sensitive device. In some embodiments, the sensory component includes a pressure sensitive device. In various embodiments, the sensory component can also include sensors that can record speed, such as rotational speed and the like.

In specific embodiments, the sensory component includes a break-away feature, such that sufficient pressure from the trainee's chin and/or shoulder would cause the sensory component to collapse, depress, or otherwise move in order to reduce discomfort in the trainee and/or prevent injury.

In various embodiments, the sensory component is configured for use by a right-handed trainee and/or a left-handed trainee. In various embodiments, the sensory component is adjustable to allow for use by a right-handed trainee and/or a left-handed trainee. In some embodiments, the component can be adjusting using any suitable mechanical mechanism, such as a click-and-lock mechanism, a flexible attachment, a ball bearing system, a ball in socket mechanism, and the like. In various embodiments, the sensory component is static and configured for use by a right-handed trainee or a left-handed trainee.

In particular embodiments, the sensory component can be associated with a central processing unit (CPU). In particular embodiments, a CPU is configured to store data associated with the trainee such as the number of attempted swings, the percentage of swings in which the trainee was using proper body positioning, the amount of time spent training, the point during the swing at which the trainee gains or ceases to use proper body positioning, rotational speed of the trainee or swinging instrument (e.g., bat, racket, club), the pressure from the trainee's chin on the sensory component, and the like. In particular embodiments, the CPU is capable of connecting to an external computer or other device to download and/or transmit such information. In some embodiments the external computer or other device is one or more of a mobile device, a laptop computer, a desktop or personal computer (PC), notebook computer, a mobile digital device such as an iPod® (Apple, Cupertino, Calif.), electronic book reader, a cellular phone, a smartphone, a tablet computer, a phablet, personal data assistant, video gaming console or controller, television set top box and portable media player, or other electronic device, etc. In various embodiments, the data is downloaded and/or transmitted to the external computer in real-time. In other embodiments, the data is downloaded and/or transmitted to the external computer after a training session. The data can be used to provide feedback to a user to further improve the trainee's swing technique. The data can also be used for additional purposes such as research or marketing purposes. In some embodiments the external computer or other device comprises or is connected to a user interface device such as a monitor or other viewing device such that the downloaded and/or information can be viewed. In specific embodiments, the user interface device can present the data in real-time.

In various embodiments, data can be transmitted to the CPU from the sensory component. The transmitting and receiving aspects of the devices and methods disclosed herein can include wired or wireless components operable to communicate with one or more separate devices within a communication range of the particular wireless protocol. The wireless protocol can be any appropriate protocol used to enable devices to communicate wirelessly, such as Bluetooth, cellular, or IEEE 802.11. It should be understood that the computing device may also include one or more wired communications interfaces for coupling and communicating with other devices. In additional embodiments, the user interface device could also be a portable device that is capable of being docked with, or connected to, the training device, and can function either remotely or while docked with, or connected to, the training device.

"Real-time" or "real-time interaction" means that a response to an input is "current" as opposed to "delayed." A response in "real-time" typically occurs prior to additional input being sent, similar to a conversation in which each party takes turns speaking. "Real-time" can also refer to a system that provides a response to an external event within a given time period. As used herein, "real-time" information-processing interaction refers to a reasonable amount of time given user set-up and bandwidth, i.e., a response occurring as soon as possible for a given workload.

The alert component of the devices disclosed herein signals a user that a trainee's swing was proper or improper by emitting or altering a signal. This can be accomplished by, for example, changing a lighting status, changing lighting colors, vibrating, emitting a sound, odor, or chemical, or any other manner that can signal a user, or any combination thereof. The signal can be emitted or altered in real-time or after a delay. In various embodiments, the delay can be at least 1 second, at least 2 seconds, at least 3 seconds, at least 4 seconds, at least 5 seconds, at least 10 seconds, at least 15 seconds, at least 20 seconds, at least 30 seconds, at least 45 seconds, at least 1 minute, at least 2 minutes, at least 3 minutes, at least 4 minutes, at least or 5 minutes. In various embodiments, the delay can be no greater than 1 second, no greater than 2 seconds, no greater than 3 seconds, no greater than 4 seconds, no greater than 5 seconds, no greater than 10 seconds, no greater than 15 seconds, no greater than 20 seconds, no greater than 30 seconds, no greater than 45 seconds, no greater than 1 minute, no greater than 2 minutes, no greater than 3 minutes, no greater than 4 minutes, no greater than or 5 minutes. In some embodiments, the user can select the amount of the delay.

In some embodiments the alert component can comprise a light, light bar, or series of lights. The light(s) can be flashing on and off, changing colors, changing intensity of the lights, or changing patterns where there is a series of lights, etc. Further, the light(s) can be white and/or colored; or, in embodiments comprising a series of lights, the lights can be all the same color or a variety of colors. In particular embodiments, various configurations of signaling can convey different information regarding a particular swing beyond maintenance of head position. For example, particular signals can indicate speed of a swing, height of the swinging instrument at various points during the swing, position of contact with the intended object, etc.

In some embodiments, the alert component can include an audible signal. In various embodiments, the audible signal can be a buzzer, a bell, a horn, a siren, an alarm, a pre-recorded message, and the like.

In some embodiments, the alert component can signal by vibrating.

In various embodiments, the alert component is contained in a housing. In various embodiments, the alert component is contained in two or more independent housings. In various embodiments, the alert component is made of up two or more housings connected via a cord, cable, string, lanyard, or the like. In various embodiments, the alert component may include a software application and/or a mobile device.

In particular embodiments, the alert component can be adjustable. For example, the alert component can be adjustable to suit particular use characteristics such as the height of the user or the physical environment such as the presence of visual obstructions or winds. In more particular embodiments, one or more of the height, position, angle, tilt, and/or rotational position of the alert component can be adjustable. As an example, when the alert component includes a speaker emitting sounds, the volume of the sound can be adjusted up or down. As another example, when the alert component includes a light bar, the lights may be adjusted to be brighter for day use and dimmer for night use or vice versa. As a further example, when the signal used is vibration, the intensity of vibration, the pattern of vibration, the length of time the vibration lasts, etc. can be adjusted.

Multiple alert components may be available in a single device, such that the user could select one or more alert component(s) depending on the characteristics or preference of the user and/or the physical environment. The alert component may also be removably coupled such that it is interchangeable and a user can select a particular alert component depending on the characteristics or preference of the user and/or the physical environment.

In various embodiments wherein each device includes more than one alert component, an alert component that creates sound can be turned off while an alert component creates light can be turned on, and vice versa. As is understood by one of ordinary skill in the art, various other hinges, sliders, clips, locking devices, etc. can be used to create adjustable visual enhancements and/or alert components.

The alert component can also include a signaling pattern selector. In various embodiments, the signaling pattern selector can be a switch, a button, a toggle, a dial, a touchpad, or the like, or any combination thereof. The signaling pattern selector can also be a mobile device, a laptop computer, a desktop computer, notebook computer, a mobile digital device such as an iPod® (Apple, Cupertino, Calif.), electronic book reader, a cellular phone, a smartphone, a tablet computer, a phablet, personal data assistant, video gaming console or controller, television set top box and portable media player, or other electronic device, etc., and the like.

In various embodiments, the alert component only signals a trainee or only signals a non-trainee user. In various embodiments, the alert component signals a one or more users.

Methods of using the devices described herein are also disclosed. In various embodiments, methods of indicating proper body positioning, specifically head and neck positioning, during a swing can include coupling a device described herein to a trainee, positioning the device such that the approximate vertex of the positioning component rests on the dorsal surface of the trainee's neck, and alerting the user when the proper body position is utilized during a swing. In various embodiments, method of indicating improper head and neck positioning during a swing can include coupling a device described herein to a trainee, positioning the device such that the approximate vertex of the positioning component rests on the dorsal surface of the trainee's neck, and alerting the user when the proper body position is no longer being utilized during a swing. In another embodiment, a method of teaching trainees the correct head position during a swing is disclosed.

In various embodiments, methods of alerting a user of a trainee's head and neck positioning during a swing can include coupling a device described herein to the trainee, positioning the device such that the approximate vertex of the positioning component rests on the dorsal surface of the trainee's neck, and alerting the user when the proper body position is utilized during a swing. In various embodiments, methods of alerting a user of a trainee's head and neck positioning during a swing can include coupling to the trainee a device as described herein, positioning the device such that the approximate vertex of the positioning component rests on the dorsal surface of the trainee's neck, and alerting the user when improper body position is utilized during a swing.

In some embodiments, the devices disclosed herein can be used to train a user to select only certain pitches at which to swing. For example, in the context of baseball, a trainee is encouraged to only swing at pitches inside his or her "strike zone." In various embodiments, the devices disclosed herein can provide negative reinforcement if a trainee swings at a high, low, or otherwise unsuitable pitch. The negative reinforcement can be in the form of discomfort to the user, an alert, and the like. In various embodiments, methods of training a user to select suitable pitches are disclosed.

Exemplary Embodiments

The Examples below describe the optimization of the methods disclosed herein. These Examples are included to demonstrate particular embodiments of the disclosure. Those of ordinary skill in the art should recognize in light of the present disclosure that many changes can be made to the specific embodiments disclosed herein and still obtain a like or similar result without departing from the spirit and scope of the disclosure.

1. A training device to provide an alert regarding head and neck positioning during a trainee's swing including:

a positioning component including a substantially U-shaped length;

a sensory component which makes contact with the trainee's chin when proper head and neck positioning is achieved while swinging, and which sends a signal when said contact is made; and an alert component which receives the signal from the sensory component and emits an alert.

2. A training device of embodiment 1, wherein the device further includes a securing device.
3. A training device of embodiment 2, wherein the securing device is a clip or a pin.
4. A training device of any one of embodiments 1-3, wherein the alert is audible, visual, and/or vibratory.
5. A training device of any one of embodiments 1-4, wherein the alert is selected from a group consisting of a buzzer, a bell, a horn, a siren, an alarm, or a pre-recorded message.
6. A training device of any one of embodiments 1-5, wherein the alert is a change in the color of a light, a change in a status of a light, a change in a pattern of lights, or a combination thereof.
7. A training device of any one of embodiments 1-6, wherein the alert is vibratory.
8. A training device of any one of embodiments 1-7, wherein the alert notifies a non-trainee user and/or the trainee.
9. A training device to provide an alert regarding head and neck positioning during a trainee's swing including:

a positioning component including a substantially U-shaped length;

a sensory component which makes contact with the trainee's chin when proper head and neck positioning is maintained while swinging, and which sends a signal when the trainee's chin ceases to make contact with the sensory component; and an alert component which receives the signal from the sensory component and emits an alert.

10. A training device of embodiment 9, wherein the device further includes a securing device.
11. A training device of embodiment 10, wherein the securing device is a clip or a pin.
12. A training device of any one of embodiments 9-11, wherein the alert is audible, visual, and/or vibratory.

13. A training device of any one of embodiments 9-12, wherein the alert is selected from a group consisting of a buzzer, a bell, a horn, a siren, an alarm, or a pre-recorded message.
14. A training device of any one of embodiments 9-13, wherein the alert is a change in the color of a light, a change in a status of a light, a change in a pattern of lights, or a combination thereof.
15. A training device of any one of embodiments 9-14, wherein the alert is vibratory.
16. A training device of any one of embodiments 9-15, wherein the alert notifies a non-trainee user and/or the trainee.
17. A method of providing an alert regarding a trainee's head and neck positioning during a swing including:

coupling to the trainee a device including a positioning component including a substantially U-shaped length; a sensory component, which makes contact with the trainee's chin when proper head and neck positioning is achieved while swinging, and which sends a signal when said contact is made; and an alert component which receives the signal from the sensory component and emits an alert;

positioning the device such that the approximate vertex of the positioning component rests on the dorsal surface of the trainee's neck; and emitting an alert when the proper body position is utilized during a swing.

18. A method of embodiment 17, wherein the alert notifies a non-trainee user and/or the trainee.
19. A method of providing an alert regarding a trainee's head and neck positioning during a swing including:

coupling to the trainee a device including a positioning component including a substantially U-shaped length; a sensory component which makes contact with the trainee's chin when proper head and neck positioning is maintained while swinging, and which sends a signal when the trainee's chin ceases to make contact with the sensory component; and an alert component which receives the signal from the sensory component and emits an alert to notify the user;

positioning the device such that the approximate vertex of the positioning component rests on the dorsal surface of the trainee's neck; and emitting an alert when improper body position is utilized during a swing.

20. A method of embodiment 19, wherein the alert notifies a non-trainee user and/or the trainee.
21. A training device to provide an alert regarding a trainee's head and neck positioning during a swing including:

a positioning component including a substantially U-shaped length;

a sensory component which (i) makes contact with the trainee's chin when proper head position is achieved while swinging, and which sends a signal when said contact is made, or (ii) makes contact with the trainee's chin when proper head position is maintained while swinging, and which sends a signal when the trainee's chin ceases to make contact with the sensory component; and an alert component which receives the signal from the sensory component and emits an alert to notify a user.

22. A training device of embodiment 21, wherein the positioning component further includes a securing device.
23. A training device of embodiment 22, wherein the securing device is a clip or a pin.
24. A training device of any one of embodiments 21-23, wherein the alert is audible, visual, and/or vibratory.
25. A training device of any one of embodiments 21-24, wherein the alert is selected from a group consisting of a buzzer, a bell, a horn, a siren, an alarm, or a pre-recorded message.
26. A training device of any one of embodiments 21-25, wherein the alert is a change in the color of a light, a change in a status of a light, a change in a pattern of lights, or a combination thereof.
27. A training device of any one of embodiments 21-26, wherein the alert is vibratory.
28. A training device of any one of embodiments 21-27, wherein the alert notifies a non-trainee user and/or the trainee.

As will be understood by one of ordinary skill in the art, each embodiment disclosed herein can comprise, consist essentially of, or consist of its particular stated element, step, ingredient, or component. Thus, the terms "include" or "including" should be interpreted to recite: "comprise, consist of, or consist essentially of." As used herein, the transition term "comprise" or "comprises" means includes, but is not limited to, and allows for the inclusion of unspecified elements, steps, ingredients, or components, even in major amounts. The transitional phrase "consisting of" excludes any element, step, ingredient, or component not specified. The transition phrase "consisting essentially of" limits the scope of the embodiment to the specified elements, steps, ingredients, or components and to those that do not materially affect the embodiment. As used herein, a material effect would cause a statistically significant reduction in the accuracy of the device's alerts regarding proper and/or improper body positioning.

Unless otherwise indicated, all numbers used in the specification and claims are to be understood as being modified in all instances by the term "about." Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. When further clarity is required, the term "about" has the meaning reasonably ascribed to it by a person skilled in the art when used in conjunction with a stated numerical value or range, i.e. denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

Similarly, unless otherwise indicated, descriptions of shapes (including references to symmetry and size) used herein are to be understood as being modified in all instances by the term "substantially." Accordingly, unless indicated to the contrary, the descriptions of shapes set forth in the specification and attached claims are approximations that may vary depending upon the desired properties sought to be obtained by the present invention.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

Definitions and explanations used in the present disclosure are meant and intended to be controlling in any future construction unless clearly and unambiguously modified in the examples or when application of the meaning renders any construction meaningless or essentially meaningless. In cases where the construction of the term would render it meaningless or essentially meaningless, the definition should be taken from Webster's Dictionary, 3rd Edition or a dictionary known to those of ordinary skill in the art.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A training device to provide an alert regarding head and neck positioning during a trainee's swing comprising:

a positioning component comprising a substantially U-shaped length, a first end, and a second end;

a sensory component coupled to the positioning component at the first end of the positioning component, the sensory component comprising a housing containing an electronic sensor comprising at least one of a capacitive sensor or a resistive sensor configured to detect a contact of the trainee's chin on the housing of the sensory component during the trainee's swing, wherein the training device is configured to allow the trainee to select a mode, from multiple different modes, by which the training device is to operate, the multiple different modes including:

(i) a first mode where the sensory component sends a signal to alert the trainee that proper head and neck positioning was achieved at an end of the trainee's swing in response to the electronic sensor detecting that the contact of the trainee's chin is made on the housing of the sensory component at the end of the trainee's swing, (ii) a second mode where the sensory component sends the signal to alert the trainee that proper head and neck positioning was not maintained throughout the trainee's swing in response to the electronic sensor detecting that the trainee's chin ceases to make the contact with the housing of the sensory component during the trainee's swing, and (iii) a third mode where the sensory component sends the signal to alert the trainee that proper head and neck positioning was not maintained throughout the swing in response to the electronic sensor failing to detect any contact of the trainee's chin on the housing of the sensory component during the trainee's swing, wherein the electronic sensor failing to detect any contact during the trainee's swing indicates that the trainee's chin failed to make contact with the housing of the sensory component during the trainee's swing, and wherein if the alert does not sound during the trainee's swing in the third mode, proper head and neck positioning was maintained throughout the trainee's swing; and an alert component coupled to the sensory component and configured to receive the signal from the sensory component and emit an alert.

2. A training device of claim 1, further comprising a securing device coupled to the positioning component at the second end.

3. A training device of claim 1, wherein the alert is audible, visual, and/or vibratory.

4. A training device of claim 3, wherein the alert is selected from a group consisting of a buzzer, a bell, a horn, a siren, an alarm, or a pre-recorded message.

5. A training device of claim 3, wherein the alert is a change in a color of a light, a change in a status of a light, a change in a pattern of lights, or a combination thereof.

6. A training device of claim 1, wherein the alert component couples the sensory component to the positioning component at the first end of the positioning component.

7. A training device of claim 1, wherein the sensory component is hemispherical in shape.

8. A training device of claim 1, wherein the positioning component is made of a flexible bistable spring contained within a fabric cover, a plastic cover, or a foam cover.

9. A training device of claim 1, wherein the sensory component includes a break-away feature that causes the sensory component to collapse, depress, or move upon an amount of pressure on the sensory component being reached.

10. A training device of claim 1, wherein the sensory component further comprises one or more sensors to record rotational speed data, and wherein the training device further comprises a central processing unit (CPU) configured to transmit the rotational speed data to an external computer in real-time.

11. A training device to provide an alert regarding a trainee's head and neck positioning during a swing comprising:

a positioning component comprising a substantially U-shaped length, a first end, and a second end;

a sensory component coupled to the positioning component at the first end of the positioning component, the sensory component comprising a housing containing an electronic sensor configured to detect a contact of the trainee's chin on the housing of the sensory component during the swing, wherein the training device is configured to allow the trainee to select a mode, from multiple different modes, by which the training device is to operate, the multiple different modes including:

(i) a first mode where the sensory component sends a signal to alert the trainee that proper head and neck positioning was achieved at an end of the swing in response to the electronic sensor detecting that the contact of the trainee's chin is made on the housing of the sensory component at the end of the swing, (ii) a second mode where the sensory component sends the signal to alert the trainee that proper head and neck positioning was not maintained throughout the swing in response to the electronic sensor detecting that the trainee's chin ceases to make the contact with the housing of the sensory component during the swing, and (iii) a third mode where the sensory component sends the signal to alert the trainee that proper head and neck positioning was not maintained throughout the swing in response to the electronic sensor failing to detect any contact during the swing, wherein the electronic sensor failing to detect any contact during the swing indicates that the trainee's chin failed to make contact with the housing of the sensory component during the swing, and wherein if the alert does not sound during the swing in the third mode, proper head and neck positioning was maintained throughout the swing; and an alert component coupled to the sensory component and configured to receive the signal from the sensory component and emit an alert.

12. A training device of claim 11, further comprising a securing device coupled to the positioning component at the second end.

13. A training device of claim 11, wherein the alert is audible, visual, and/or vibratory.

14. A training device of claim 13, wherein the alert is selected from a group consisting of a buzzer, a bell, a horn, a siren, an alarm, or a pre-recorded message.

15. A training device of claim 13, wherein the alert is a change in a color of a light, a change in a status of a light, a change in a pattern of lights, or a combination thereof.

16. A training device of claim 11, wherein the electronic sensor comprises a capacitive sensor or a resistive sensor.

17. A training device of claim 11, wherein the alert component is communicatively coupled to the sensory component via a wireless communication protocol, and is configured to receive the signal wirelessly from the sensory component.

18. A method of using a device configured to emit an alert regarding a trainee's head and neck positioning during a swing comprising:

receiving, by the device, a selection of a selected mode, from among multiple different modes, by which the device is to operate, wherein the device comprises:

a positioning component having a substantially U-shaped length, a first end, and a second end;

a sensory component coupled to the positioning component at the first end of the positioning component, the sensory component comprising a housing containing an electronic sensor configured to detect a contact of the trainee's chin on the housing of the sensory component during the swing and to send a signal to alert the trainee; and an alert component coupled to the sensory component and configured to receive the signal from the sensory component and emit an alert, wherein the multiple different modes include:

a first mode where the sensory component sends the signal to alert the trainee that proper head and neck positioning was achieved at an end of the swing in response to the electronic sensor detecting that the contact of the trainee's chin is made on the housing of the sensory component at the end of the swing;

a second mode where the sensory component sends the signal to alert the trainee that proper head and neck positioning was not maintained throughout the swing in response to the electronic sensor detecting that the trainee's chin ceases to make the contact with the housing of the sensory component during the swing; and a third mode where the sensory component sends the signal to alert the trainee that proper head and neck positioning was not maintained throughout the swing in response to the electronic sensor failing to detect any contact during the swing, wherein the electronic sensor failing to detect any contact during the swing indicates that the trainee's chin failed to make contact with the housing of the sensory component during the swing and wherein if the alert does not sound during the swing in the third mode, proper head and neck positioning was maintained throughout the swing; and sending, by the sensory component, the signal to the alert component based at least in part on the selected mode, and based at least in part on output from the electronic sensor; and emitting, by the alert component and based on the signal received from the sensory component, the alert during the swing.

* * * * *